United States Patent [19]

Gerfen

[11] Patent Number: 4,570,369

[45] Date of Patent: Feb. 18, 1986

[54] CYLINDRICAL, FALLING BREECH BLOCK, RIFLE ACTION

[76] Inventor: Raymond F. Gerfen, 7057 Autumn Chase, San Antonio, Tex. 78238

[21] Appl. No.: 536,386

[22] Filed: Sep. 27, 1983

[51] Int. Cl.[4] ..... F41C 11/04; F41C 7/06

[52] U.S. Cl. ..... 42/23

[58] Field of Search ..... 42/23

[56] References Cited

U.S. PATENT DOCUMENTS

| | | | |
|---|---|---|---|
| 212,593 | 2/1879 | Deeley et al. | 42/23 |
| 220,285 | 10/1879 | Hepburn | 42/23 |
| 247,056 | 9/1881 | Hebbard | 42/23 |
| 465,354 | 12/1891 | Davenport | 42/23 |
| 592,239 | 10/1897 | Davenport | 42/23 |
| 3,355,833 | 12/1967 | Ruger et al. | 42/23 |

*Primary Examiner*—Charles T. Jordan
*Assistant Examiner*—Ted L. Parr
*Attorney, Agent, or Firm*—John C. Stahl

[57] ABSTRACT

An action for a single shot rifle featuring a cylindrical, falling breech block actuated by a pivoting finger lever which also serves as the trigger guard, and an extractor/ejector for the cartridge. The safety mechanism locks the trigger and striker thereby assuring maximum safety in case of failure of the trigger mechanism.

5 Claims, 11 Drawing Figures

CYLINDRICAL, FALLING BREECH BLOCK, RIFLE ACTION

BACKGROUND OF THE INVENTION

The prior art is replete with drop breechblock rifle actions. Typical prior art teachings include U.S. Pat. Nos. 139,422, 151,478, 212,593, 220,285, 247,056, 442,106, 3,355,833 and 4,095,363.

Many of these prior art teachings include square or rectangular falling breechblocks wherein the stresses at firing are concentrated in the corners of the corresponding breechblock recesses. In the cylindrical, falling breech block action of the subject invention, the stresses associated with high pressure cartridges are distributed about the entire rear surface of the circular recess of the receiver in which the breech block is carried. These circular recesses are located in both the top and bottom portions of the rear of the receiver.

SUMMARY OF THE INVENTION

The primary object of the invention is to provide a cylindrical, falling breech block, rifle action wherein the stresses associated with the firing of high pressure cartridges are distributed around the entire rear of the top and bottom circular recesses for the breech block.

Another object of the invention is to provide such a rifle action including means for loading a cartridge into the rifle chamber through an opening in the side of the receiver so as to avoid interference with a telescope sight normally mounted as close as possible to the top of said receiver.

Still another object is to provide such a rifle action wherein the trigger safety mechanism not only prevents movement of the trigger but also provides maximum safety in case of failure between the trigger and sear.

A further object is to provide such a rifle action wherein the safety cannot be moved to the "safe" position unless the rifle is cocked, and the action may be opened or closed with the safety catch in the "safe" position.

Another object is to provide such a rifle action which is relatively inexpensive and easy to manufacture, and adaptable for use over extended periods of time with a minimum of maintenance.

Other objects and features of the invention will become apparent to those skilled in the art from the following specification when read in the light of the annexed drawings.

DESCRIPTION OF THE PREFERRED EMBODIMENTS

Figure 1:
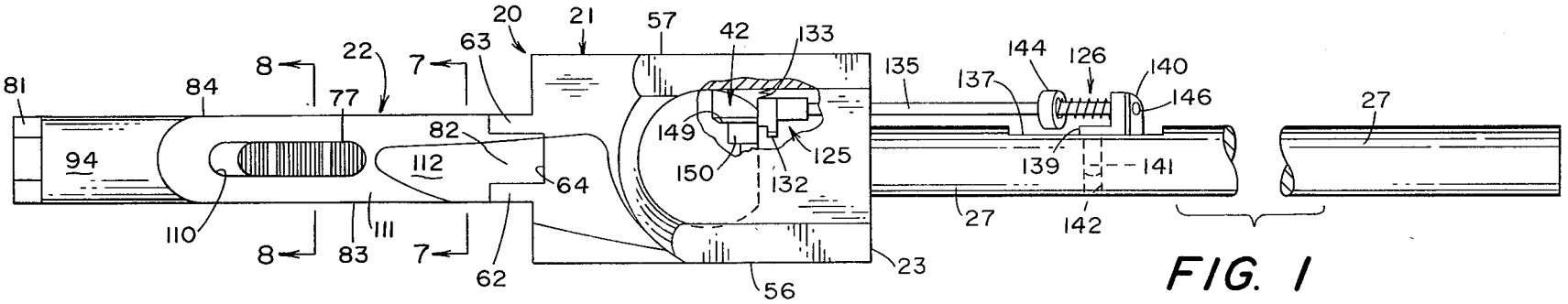
FIG. 1 is a top plan view, partly broken away and partly in section, of the subject invention, showing the relationship between the breech block and the extractor/ejector.
Figure 3:
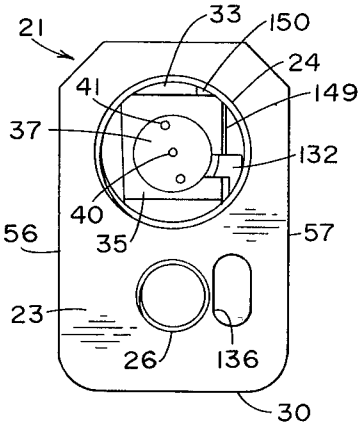
FIG. 3 is a front elevational view of the face of the receiver.

Referring now to the drawings, wherein like reference numerals designate like or corresponding parts throughout the several views, there is shown in FIG. 1 a preferred embodiment of cylindrical, falling breech block, rifle action 20 of the subject invention comprising essentially rectangularly-shaped receiver 21 and trigger housing 22 detachably secured thereto. Front 23 of said receiver is provided with female threads 24 in the upper half, along the central axis, to accommodate threaded shank of barrel 25; female threads 26 of lesser diameter and vertically below said barrel accommodate threaded shank of hanger 27 of rod or tubular stock, adapted to carry the forearm which is secured thereto by means of a rearwardly extending thru-bolt (not shown) or a transversely extending pin or the like passed through aligned bores in the forearm and the approximate foremost end of said hanger.

Figure 2:
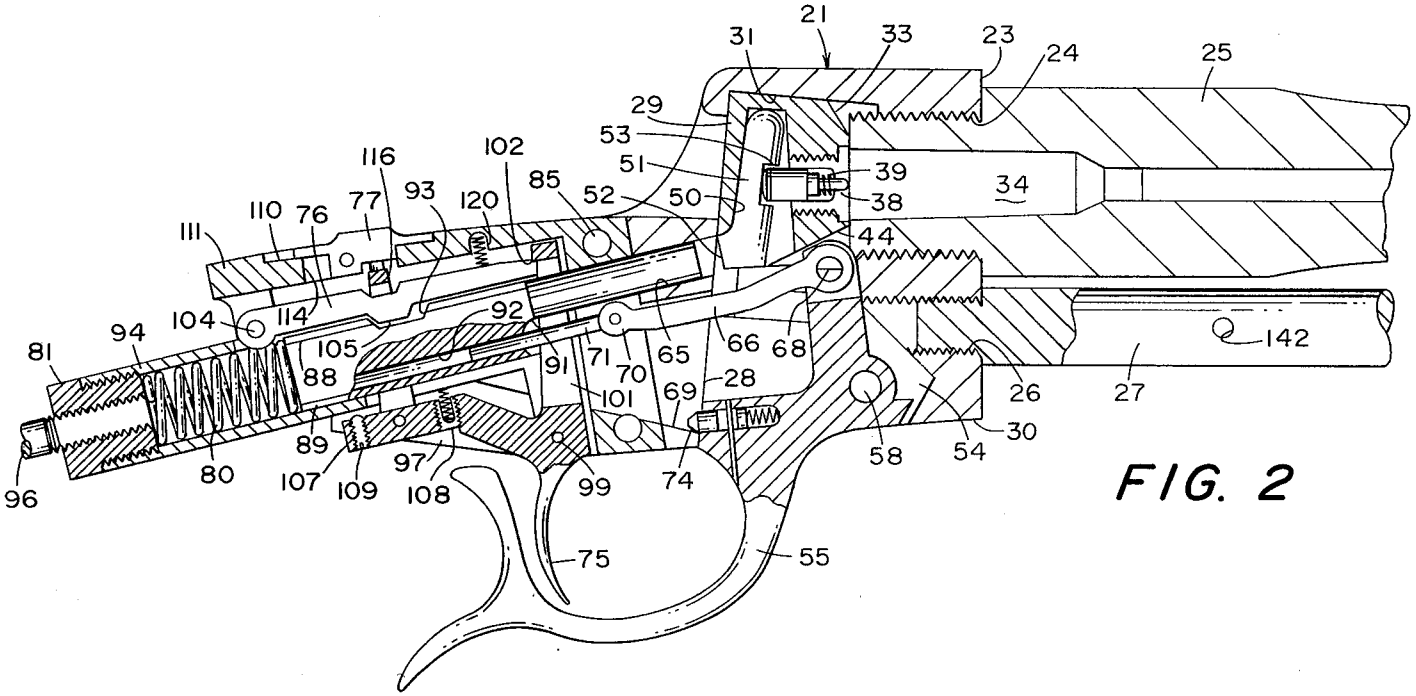
FIG. 2 is a fragmentary, vertical sectional view, taken along the approximate major axis of the preferred embodiment.

As best seen in FIG. 2, hole 28 for sliding, cylindrical breech block 29 is provided in the approximate center of said receiver, extends angularly upwardly and forwardly from bottom 30 and terminates upwardly in top 31; said hole is centered on the barrel axis with the center line of said hole at an angle of ninety-five degrees with respect to the center line of the bore of said barrel.

Figure 4:
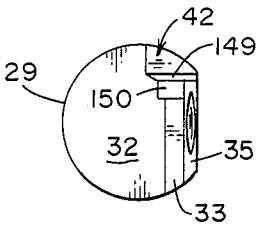
FIG. 4 is a top plan view of the cylindrical breech block.
Figure 5:
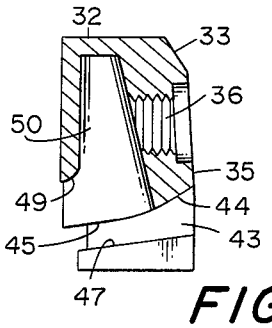
FIG. 5 is a vertical sectional view through the medial axis of the breech block of FIG. 4.
Figure 6:
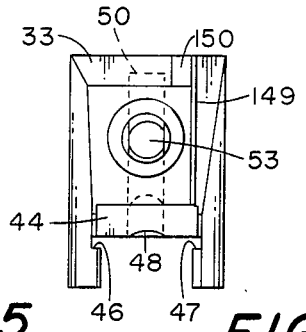
FIG. 6 is a front elevational view of the breech block of FIG. 4 with the firing pin bushing removed.

Referring now to FIGS. 4–6 of the drawings, breech block 29 is essentially cylindrical comprising flat top 32 terminating forwardly in transversely extending bevel 33 which aids in starting a cartridge into chamber 34, and front face 35 machined flat at an angle of five degrees with respect to the center line of said block so that said face contacts the rear end of barrel 25 to seal chamber 34. Female threads 36 in said face accommodate firing pin bushing 37 which carries firing pin 38 normally biased rearwardly by spring 39 and adapted to be forced forwardly through bore 40. Diagonally extending holes 41 equidistantly of bore 40 facilitate removal of said bushing. Vertical recess 42 in the foremost, left-hand side of said breech block provides space for the extractor to move laterally when the action is fully open, as will hereinafter be more fully described.

Breech block 29 further includes essentially "T" shaped, longitudinally extending slot 43 which opens downwardly, bounded respectively by angularly declining surface 44, horizontal base 45, and laterally spaced, rearwardly directed and angularly declining surfaces 46–47. Upwardly and rearwardly opening slot 48 lying in the major plane extends at least slightly forwardly into surface 44, extends rearwardly through base 45 and terminates in an upwardly extending, arcuate recess 49 in the rear surface of said block. A relatively narrow, vertically extending chamber 50 extends along the major axis and communicates downwardly with slot 48 heretofore mentioned. An essentially "L" shaped transfer bar 51 is carried in chamber 50 with end 52 in recess 49 terminating at least slightly anteriorly of the rearmost vertical surface of said breech block. The front, medial portion of said bar includes recess 53 into which the base of firing pin 38 inserts; a force applied to said transfer bar is thus applied to the firing pin to activate the same. The lower portion of bar 51 moves approximately one-eighth inch and is arrested in its forward movement by abutting the foremost end of slot 48.

It is to be noted that breech block 29 in the receiver is inclined at a five degree angle with respect to barrel 25 and the breech block moves rearwardly away from the barrel as the action in opened. This not only provides clearance for a spent cartridge as the action is opened but also provides a powerful camming action to seat a slightly oversize cartridge in chamber 34 as the action is closed and locked.

As indicated by reference numeral 54, an irregularly-shaped opening in bottom 30 of the receiver anteriorly of hole 28 communicates rearwardly therewith to accommodate finger lever 55, said lever is secured laterally to opposing sides 56–57 of said receiver by transversely extending pivot pin 58. If desired, a pivot pin locking screw (not shown) surfacing in bottom 30 approximately vertically below said pivot pin 58 is adjusted to bear thereagainst. Finger lever 55 includes an integrally formed and essentially perpendicularly extending arm 59 which terminates upwardly in longitudinal slot 60 with rearwardly declining surface 61 adapted to bear against surface 44 of said breech block. A wedging action occurs between angled surface 61 on finger lever and angled surface 44 of the breech block when the action is closed thereby preventing said breech block from moving downwardly unless finger lever 55 is manually rotated by the marksman.

Receiver 21 terminates rearwardly in laterally spaced, vertically extending flanges 62–63 separated by web 64; hole 65 lying along the major axis and extending angularly upwardly passes through the upper, rearmost portion of said receiver, opening in web 64.

Figure 11:
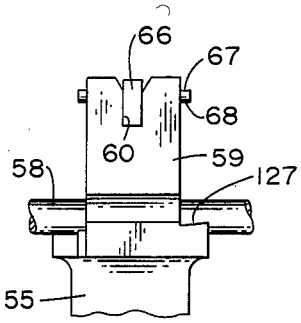
FIG. 11 is a fragmentary, front elevational view showing the front end of finger lever of the subject invention.

The foremost end of cocking bar 66 inserts into slot 60 in arm 59 of the finger lever and is retained therein by pivot pin 67; as best seen in FIGS. 2 and 11, the remote ends of pin 67 are shouldered, indicated by reference numeral 68, said shoulders provide good contact and are adapted to ride on rearwardly declining surfaces 46, 47 respectively. The remote end of said cocking bar passes through vertically elongate slot 69 provided below hole 65 in the lower approximate two-thirds of said web 64; cocking bar 66 normally terminates rearwardly of flanges 62, 63 in yoke 70, the outer members of which are essentially circular in elevation. Elongate rod 71 terminates forwardly in head 72 pivotally connected to said yoke by pin 73 passing through such parts. Spring biased detent 74 in the rearmost end of finger lever 55 extends into the lower portion of slot 69 in the normally closed condition of said finger lever.

Trigger housing 22 is machined or investment cast with cavities therein for trigger 75, sear 76, safety 77, safety block 78, striker 79, mainspring 80, mainspring cap screw 81 and the rear end of cocking bar 66 heretofore mentioned. The trigger housing thus formed terminates forwardly in rectangular tongue 82 adapted to fit intermediate flanges 62, 63 of the receiver with the corresponding sides 83–84 of said housing aligned with the corresponding outer surfaces of flanges 62–63, respectively. Pins 85 pass through aligned bores in flanges 62, 63 and tongue 82. Axially and slightly inclined bore 86 extends through the trigger housing, terminating forwardly in tongue 82; the central axis of bore 86 parallels the corresponding axis of hole 65 and communicates therewith.

Striker 79 (see FIGS. 2 and 9) comprises an elongate rectangular body 87 with arcuate top and bottom surfaces 88–89, respectively, conforming to and inserting into bore 86 in a relatively close fit; said striker terminates forwardly in section 90 which is circular in cross section. The upper surface of the striker in retracted condition bears against the upper, arcuate segment of said bore 86 with section 90 of said striker carried in hole 65. Arcuate, transversely extending recess 91 in the lower, foremost end of body 87 is adapted to receive yoke 70 in one position. Longitudinally extending bore 92 in body 87 parallels the central axis of bore 86 and opens forwardly in recess 91 to accommodate rod 71. It is to be understood that bore 92 may extend completely through body 87 or a lateral bore (not shown) communicates with the remote end of said bore. As will hereinafter be more fully described, transversely extending notch 93 is provided in the medial, upper surface of body 87 of said striker.

Trigger housing 22 terminates rearwardly in cylindrical member 94 coaxial with bore 86 and carrying mainspring 80; cap screw 81 is adjusted to bear against said mainspring which in turn regulates spring tension applied to rear end 95 of body 87. If desired, thru-bolt 96 may be threaded into the remote end of cap screw 81 to additionally secure action 20 in the stock of the rifle.

Figure 7:
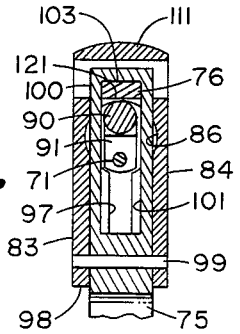
FIG. 7 is a vertical sectional view taken on the line 7—7 of FIG. 1, looking in the direction of the arrows, with the action in cocked and locked condition.
Figure 9:
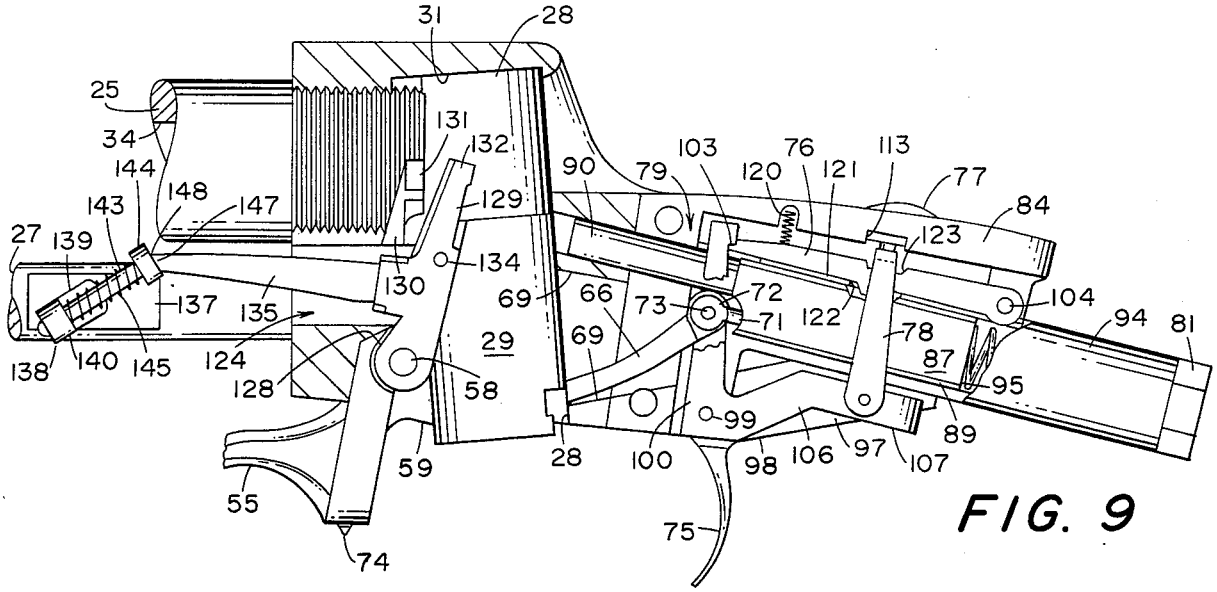
FIG. 9 is a fragmentary, vertical sectional view along the approximate major axis of the action, showing the extractor/ejector in retracted condition.

Referring now to FIGS. 7 and 9 of the drawings, an elongate, shaped recess 97 surfaces downwardly in bottom 98 of the trigger housing and extends forwardly into tongue 82 with the lower surface thereof coextensive with the corresponding surface of slot 69 in said receiver. Trigger 75 is pivotally mounted in recess 97 by means of pivot pin 99 passing through aligned bores in such parts. Arm 100 of said trigger extends essentially vertically with an elongate, longitudinally and vertically extending slot 101 therein, said arm terminates upwardly in rearwardly directed notch 102 adapted to engage shoulder 103 on the fore-end of sear 76. Rearwardly, the sear is pivotally mounted intermediate sides 83, 84 of said trigger housing by pin 104 passing through aligned bores in such parts; the medial portion of sear 76 includes a transversely extending and downwardly depending projection 105 generally conforming to and adapted to insert into notch 93 in striker body 87. Slot 101, heretofore mentioned, is of sufficient width to provide clearance for the fore and aft movement of the striker and of sufficient height to accommodate cocking bar 66, yoke 70, rod 71 connecting thereto, and the forward portion of sear 76.

Trigger 75 further includes integrally formed, rearwardly extending and angularly inclined section 106 with section 107 extending horizontally and essentially perpendicular to arm 100. As best seen in FIG. 2, trigger spring adjusting screw 108 and trigger overtravel adjusting screw 109, such as are well known in the art, are provided in section 107 of said trigger. Section 107 rearwardly of adjusting screw 108 is normally of reduced width.

Elongated oval recess 110 in tang 111 of the trigger housing 22 accommodates safety 77; desirably cartridge guide 112 is provided in tang 111 anteriorly of recess 110 and extends forwardly into the tongue. Transversely extending and downwardly opening slot 113 surfacing laterally insides 83, 84 of said trigger housing communicates upwardly with longitudinally extending slot 114 in said recess 110 and hole 115 in the undersurface of safety 77.

Figure 8:
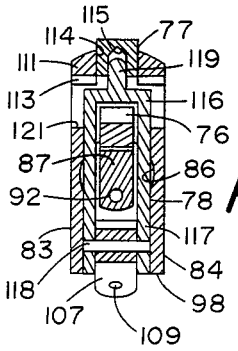
FIG. 8 is a vertical sectional view, taken on the line 8—8 of FIG. 1, looking in the direction of the arrows, with the action in cocked and locked condition.

As viewed in FIG. 8, safety block 78 is of essentially inverted "U" shape, comprising horizontal cross piece 116 which extends at least partially upwardly into slot 113 when the trigger is pulled, vertically depending legs 117 adapted to pass laterally of the approximate medial portion of section 107 of trigger 75 is pivotally secured thereto by pin 118. Central boss 119 or the like formed on the upper surface of cross piece 116 normally inserts into hole 115 in the safety. Sear 76 is normally biased downwardly by spring 120 and abuts flat 121; at such time projection 105 on said sear passes downwardly through recess 122 in flat 121. When the action is cocked, safety 77 may be moved rearwardly in recess 110 and in this locked or "safe" position, cross piece 116 of safety block 78 clears and is rearwardly of slot 113 and notch 123 in the upper surface of said sear is in approximate vertical alignment with projection 105. In such locked or "safe" position, cross piece 116 prevents activation of trigger 75 and additionally provides maximum safety in case of any failure of the trigger mechanism in that projection 105 of the sear is prevented from rising from its mating notch 93 in the striker body.

It is to be understood that recess 122 in flat 121 may be elongated anteriorly and in such modification of the invention the sear contacts the upper, forward arcuate surface 88 of striker body 87.

For purposes of description only, extractor/ejector hereinafter designated by reference numeral 124 comprises extractor 125 and ejector 126. As shown in FIG. 11, the front, left-hand side of arm 59 of finger lever 55 is machined to provide space for extractor 125, pivotally mounted on pin 58; inwardly inclined surface 127 of the foremost, left side of said finger lever contacts the lower, foremost edge 128 of said extractor when the action is almost completely open (see FIG. 9) initially forcing upper arm 129 inwardly or to the right into the cartridge extraction groove. Recess 130 in the left-hand, rearmost threaded shank of barrel 25 communicates inwardly with extractor seat 131 in the rear face of said barrel, said seat surfaces in chamber 34. Upper arm 129 of said extractor is adapted to insert into recess 130 with hook 132 lying in seat 131. When the action is almost completely open, hook 132 is additionally urged inwardly by extractor spring 133 (see FIG. 1) carried in bore 134 in the approximate medial, outer surface of arm 129, said hook gripping the extraction groove and/or rim of the cartridge more securely.

Figure 10:
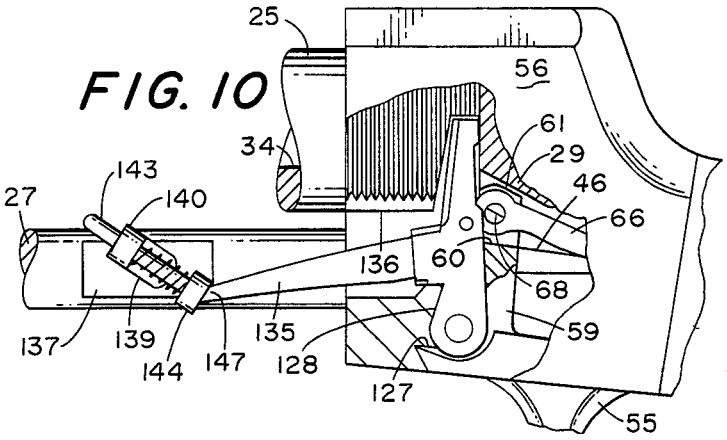
FIG. 10 is a fragmentary, side elevational view, partly broken away and partly in section, showing the extractor/ejector in normal condition.

Forwardly directed arm 135 of extractor/ejector 125 extends through vertically elongate slot 136 in face 23 of the receiver to the left of threads 26; said extractor arm 135 coacts with ejector 126 pivotally mounted in vertical flat 137 on the left side of hanger 27 forwardly of the receiver. More specifically, L-shaped bracket 138 includes base 139 and laterally extending flanged 140; threaded trunnion 141 secured to the inner surface of base 139 inserts into transversely extending female threads 142 in the hanger permitting bracket 138 to pivot under control of arm 135. Plunger 143, terminating rearwardly in head 144, carries ejector spring 145 and is journaled in bore 146 in flange 140. Point 147 on arm 135 inserts into conical depression 148 in the rear surface of head 144. When the action is closed (see FIG. 10), point 147 on arm 135 lies below a line drawn between the centers of pin 58 and trunnion 141, respectively, and ejector spring 145 exerts a forward force upon upper arm 129 of the extractor and hook 132 presses into seat 131. As heretofore mentioned, when the action is nearly open, inclined surface 127 on the finger lever contacts foremost edge 128 causing the extractor to rotate in a clockwise direction about pin 58. At such time, point 147 on arm 135 moves above a line extending between the centers of pin 58 and trunnion 141, ejector spring 145 extends, and hook 132 moves rearwardly to eject a spent cartridge from chamber 34. In the fully retracted condition of breech block 29, upper arm 129 of the extractor rotates rearwardly into recess 42 in said breech block.

In operation, when the marksman pushes finger lever 55 downwardly and forwardly, said lever rotates about pivot pin 58. The initial movement of said finger lever causes cocking bar 66 to move rearwardly with yoke 70 bearing against recess 91 of striker 79 forcing the same rearwardly against the force applied by mainspring 80. At this moment, firing pin spring 39 forces firing pin 38 and transfer bar 51 rearwardly and breech block 29 is no longer prevented from moving downwardly by the striker. Further rotation of said lever draws breech block 29 downwardly through the interaction of opposing shoulders 68 on pivot pin 67 riding on rearwardly declining surfaces 46, 47. Final movement of the finger lever activates extractor/ejector 124 to remove the cartridge from chamber 34; at this time top 32 of the breech block is below said chamber and permits clear passage for the spent cartridge and insertion of a fresh cartridge.

When cocking bar 66 has forced striker 79 sufficiently rearwardly, projection 105 on sear 76 under pressure by sear spring 120 engages notch 93 in said striker and shoulder 103 of said sear engages notch 102 of the trigger.

The marksman now inserts a fresh cartridge into chamber 34 over top 32 of the lowered breech block 29 and past the upper arm 129 of the extractor which is in a rearward position approximately three-eighths inch from the rear face of barrel 25. When finger lever 55 is moved rearwardly and upwardly, upper arm 129 of the extractor is forced to rotate into its recess 130 in the rear of the barrel against the yielding resistance of ejector spring 145. As the extractor moves forwardly, its upper arm 129 is cammed to the left by vertical, inclined surface 149 on the breech block so that hook 132 on the extractor clears the rim of the cartridge. Secondary bevel 150 on the left of bevel 33 provides clearance for hook 132 of the extractor when breech block 29 is being raised to the closed or locked position. When the extractor is seated, extractor spring 133 forces hook 132 into the extraction groove of the cartridge. The closing movement of finger lever 55 carries forward the cocking bar 66 to clear it from the striker. The rifle may now be fired again.

With the action loaded, closed, locked and cocked, finger lever 55 is maintained in position by detent 74. Provided that safety 77 is in the forward or "fire" position, a predetermined rearward force applied to the lower portion of trigger 75 moves the top of said trigger forwardly out of engagement with the foremost end of sear 76 allowing said sear to rotate upwardly and release striker 79. Under pressure from mainspring 80 the striker moves forwardly, section 90 thereof contacts the lower, rear end of the transfer bar 51, which, as its lower end rotates forwardly, forces firing pin 38 into the primer of the cartridge to fire the rifle.

When the safety is in the forward or "fire" position, safety block 78 is moved forwardly and cross piece 116 is free to move upwardly into slot 113 in the trigger housing when the trigger is depressed. When safety 77 is in the rear or "safe" position, cross piece 116 of said safety bar fits intermediate that portion of the trigger housing rearwardly of slot 113 and the top of sear 76 preventing trigger rotation and any upward movement of the sear.

In general, safety 77 cannot be moved forwardly to the "safe" position unless the rifle is cocked and such action may be opened or closed with the safety catch in the "safe" position.

Along with the surface 61 of finger lever 55 bearing against surface 44 of breech block 29, the forward portion of section 90 of the striker 87 also serves to prevent any downward or opening movement of the breech block 29 by virtue of its proximity underneath recess 49 on the breech block at the time the rifle is fired. This provides a second or double locking arrangement for said breech block.

It should be understood, of course, that the foregoing disclosure relates to only preferred embodiments of the invention and that numerous modifications or alterations may be made therein without departing from the spirit and scope of the invention as set forth in the appended claims.

I claim:

1. A falling breech block rifle action comprising a receiver adapted to receive a chambered barrel, an essentially cylindrical breech block movable angularly upwardly and downwardly in said receiver, said breech block including upper and lower portions, a hand lever pivotally mounted in said receiver to raise and lower said breech block, a recess in said receiver adapted to receive said upper portion of said breech block in raised condition of said breech block, a trigger housing connected to said receiver, said trigger housing comprising a striker, sear, trigger, and safety block, a cocking bar connected to said hand lever and adapted to bear remotely against said striker to effect cocking of said striker, said sear adapted to engage said striker in cocked condition, and said safety block adapted to lock said trigger, sear and striker in cocked condition.

2. The invention of claim 1 wherein said breech block is inclined at a ninety-five degree interior angle measured in a clockwise direction with respect to the medial, longitudinal axis of said chambered barrel.

3. The invention of claim 1 wherein said breech block further includes a vertically extending and downwardly opening chamber, a transfer bar carried in said chamber, and a firing pin in said breech block adapted to at least partially insert into a recess in said transfer bar to retain the same in said breech block.

4. The invention of claim 1 wherein said sear includes a downwardly depending projection and said striker includes a mating notch, said projection on said sear adapted to insert into said notch in said striker in cocked condition, said safety block adapted to move rearwardly intermediate said trigger housing and said sear thereby preventing trigger rotation and upward movement of said sear.

5. The invention of claim 1 further including a forwardly directed hanger secured to said receiver, an extractor coacting with said hand lever, and an ejector pivotally mounted on said hanger and coacting with said extractor to remove a cartridge from said chambered barrel.

* * * * *